US008991808B2

(12) United States Patent
Suzuki et al.

(10) Patent No.: US 8,991,808 B2
(45) Date of Patent: Mar. 31, 2015

(54) SHEET PROCESSING APPARATUS, IMAGE FORMING SYSTEM, AND SHEET BINDING METHOD

(71) Applicants: Nobuyoshi Suzuki, Tokyo (JP); Yuusuke Shibasaki, Kanagawa (JP); Shingo Matsushita, Tokyo (JP); Takuya Morinaga, Tokyo (JP); Makoto Hidaka, Tokyo (JP); Takashi Saito, Kanagawa (JP); Satoshi Saito, Kanagawa (JP); Akihiro Musha, Kanagawa (JP); Shohichi Satoh, Kanagawa (JP); Ikuhisa Okamoto, Kanagawa (JP); Katsuhiro Kosuge, Kanagawa (JP)

(72) Inventors: Nobuyoshi Suzuki, Tokyo (JP); Yuusuke Shibasaki, Kanagawa (JP); Shingo Matsushita, Tokyo (JP); Takuya Morinaga, Tokyo (JP); Makoto Hidaka, Tokyo (JP); Takashi Saito, Kanagawa (JP); Satoshi Saito, Kanagawa (JP); Akihiro Musha, Kanagawa (JP); Shohichi Satoh, Kanagawa (JP); Ikuhisa Okamoto, Kanagawa (JP); Katsuhiro Kosuge, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 48 days.

(21) Appl. No.: 13/871,063

(22) Filed: Apr. 26, 2013

(65) Prior Publication Data

US 2013/0300050 A1 Nov. 14, 2013

(30) Foreign Application Priority Data

May 10, 2012 (JP) ..... 2012-108787
Feb. 19, 2013 (JP) ..... 2013-030113

(51) Int. Cl.

| | |
|---|---|
| ***B31F 5/02*** | (2006.01) |
| ***B65H 39/00*** | (2006.01) |
| ***B65H 39/10*** | (2006.01) |
| ***B42C 1/12*** | (2006.01) |
| ***B65H 37/04*** | (2006.01) |

(52) U.S. Cl.

CPC ..... *B65H 39/00* (2013.01); *B65H 39/10* (2013.01); *B42C 1/12* (2013.01); *B65H 37/04* (2013.01); *B65H 2301/51616* (2013.01); *B65H 2403/514* (2013.01); *B65H 2801/27* (2013.01)

USPC ..... 270/58.07; 270/58.08

(58) Field of Classification Search

USPC ..... 270/58.07, 58.08, 58.09, 52.18; 399/408; 412/6, 33

See application file for complete search history.

(56) References Cited

U.S. PATENT DOCUMENTS 6,264,191 B1 7/2001 Suzuki et al.

(Continued)

FOREIGN PATENT DOCUMENTS

JP 36-013206 5/1961

(Continued)

*Primary Examiner* — Leslie A Nicholson, III

(74) *Attorney, Agent, or Firm* — Harness, Dickey & Pierce, P.L.C.

(57) ABSTRACT

A sheet processing apparatus includes a pair of squeezing members having a projection and a recess to engage each other, to squeeze a sheet bundle inserted therebetween in a direction of thickness of the sheet bundle, and a pressure applying unit to apply pressing force to the squeezing members to squeeze and bind the sheet bundle. The pressing force generated between the squeezing members by the pressure applying unit increases in strength as a relative distance between the squeezing members decreases.

7 Claims, 16 Drawing Sheets

(56) References Cited

U.S. PATENT DOCUMENTS

| | | | | |
|---|---|---|---|---|
| 6,494,453 | B1 | 12/2002 | Yamada et al. | |
| 7,571,904 | B2 * | 8/2009 | Bober | 270/58.12 |
| 2001/0017442 | A1 | 8/2001 | Suzuki et al. | |
| 2002/0051651 | A1 | 5/2002 | Yamada et al. | |
| 2002/0060414 | A1 | 5/2002 | Yamada et al. | |
| 2002/0135119 | A1 | 9/2002 | Suzuki et al. | |
| 2013/0264762 | A1 * | 10/2013 | Matsushita et al. | 270/58.08 |

FOREIGN PATENT DOCUMENTS

| | | |
|---|---|---|
| JP | 37-007208 | 4/1962 |
| JP | 2010-189101 | 9/2010 |
| JP | 2010274623 A * | 12/2010 |

* cited by examiner

SHEET PROCESSING APPARATUS, IMAGE FORMING SYSTEM, AND SHEET BINDING METHOD

CROSS-REFERENCE TO RELATED APPLICATIONS

This patent application is based on and claims priority pursuant to 35 U.S.C. §119 to Japanese Patent Application Nos. 2012-108787, filed on May 10, 2012, and 2013-030113, filed on Feb. 19, 2013, in the Japan Patent Office, the entire disclosure of each of which is hereby incorporated by reference herein.

BACKGROUND OF THE INVENTION

1. Field of the Invention

The present invention generally relates to a sheet processing apparatus to bind together a bundle of sheets; an image forming system including the sheet processing apparatus and an image forming apparatus, such as a copier, a facsimile machine, a printer, or multifunction machine capable of at least two of these functions; and a sheet binding method used in a sheet processing apparatus.

2. Description of the Background Art

There are sheet processing apparatuses, so-called finishers or post-processing apparatuses, that align a bundle of sheets (hereinafter "a sheet bundle") output from an image forming apparatus and bind the sheet bundle with metal staples. Such sheet processing apparatuses can automatically staple a number of sheet bundles on which images are formed and are widely used for convenience and efficiency thereof.

Additionally, there are hand-held staplers, so-called staple guns or powered staplers, capable of binding sheets without metal staples. A tooth form may be used to press multiple sheets so that fibers of the sheets tangle with each other and thereby tie the sheets together, or bind the sheets together using other types of processing such as half blanking, lancing, bending, and inserting. For example, JP-S36-13206-Y discloses a hand-held stapler capable of clamp binding, and JP-S37-7208-Y discloses a hand-held stapler that makes cut holes in sheets, bends cut portions, and inserts the cut portions into the cut holes.

Sheets bundles free of staples can be directly put through a shredder. Thus, such binding tools can reduce consumption of consumables, make recycling easier, and be effective to save resources. It is to be noted that, hereinafter clamp binding refer to a binding method that involves pressing multiple sheets with a tooth form to tie the sheets, thereby causing fibers of the sheets to tangle with each other. Use of clamp binding in sheet processing apparatuses is expected to increase owing to the above-described advantages.

In conventional approaches, a pressure lever that does not include a driving source is moved by a one-rotation cam to bind or bond sheets together.

For example, JP-2010-189101-A proposes a sheet binding device to bind a bundle of sheets by forming projections and recesses in the direction of the thickness of the sheet bundle, according to the thickness of the sheet bundle. Specifically, the sheet binding device includes a pair of tooth forms movable in the thickness direction of the sheet bundle, to squeeze the sheet bundle to form the projections and the recesses in the thickness direction, and a pressure applying member to apply pressure to the pair of tooth forms. The pressure is increased as the thickness of the sheet bundle increases.

Additionally, the pressure applied to the tooth forms may be increased as the thickness of the sheet bundle increases by a configuration that includes a rotary member, a driving source to rotate the rotary member, and a flexible member to apply pressure to the tooth form that is movable. The rotary member includes a contact portion that slidingly contacts the flexible member. As the rotary member rotates in one direction and the opposite direction, the amount by which the rotary member shifts to the flexible member increases and decreases, respectively. The rotational position of the rotary member can be changed to increase the shift amount of the flexible member as the thickness of the sheet bundle increases.

To bind the sheet bundle, the pressure lever is shifted in the former approach, and the pressure applying member including the rotary member applies pressure in the latter approach. In such configurations, typically the sheet bundle is pressed with a pressure of 1000 N or greater to cause the sheet fibers to tangle with each other. A motor may be used to generate the pressure.

SUMMARY OF THE INVENTION

One embodiment of the present invention provides a sheet processing apparatus that includes a pair of squeezing members and a pressure applying unit to apply pressing force to the pair of squeezing members. The squeezing members have a projection and a recess to engage each other. A sheet bundle is inserted therebetween, squeezed in a direction of thickness of the sheet bundle, and thus bound. The pressing force generated between the squeezing members by the pressure applying unit increases in strength as a relative distance between the squeezing members decreases.

In another embodiment, an image forming system includes an image forming apparatus to form images on recording media sheets and the above-described sheet processing apparatuses.

Yet another embodiment provides a method of binding multiple sheets. The method includes a step of inserting a sheet bundle between a pair of squeezing members shaped to have a projection and a recess to engage each other, a step of primarily squeezing the sheet bundle with a first pressing force from when a relative distance between the squeezing members reaches a predetermined distance set according to the thickness of the sheet bundle to when the relative distance equals to the thickness of the sheet bundle, and a step of secondarily squeezing the sheet bundle with a second pressing force stronger than the first pressing force, from when the relative distance between the squeezing members equals to the thickness of the sheet bundle to completion of sheet binding.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1B:
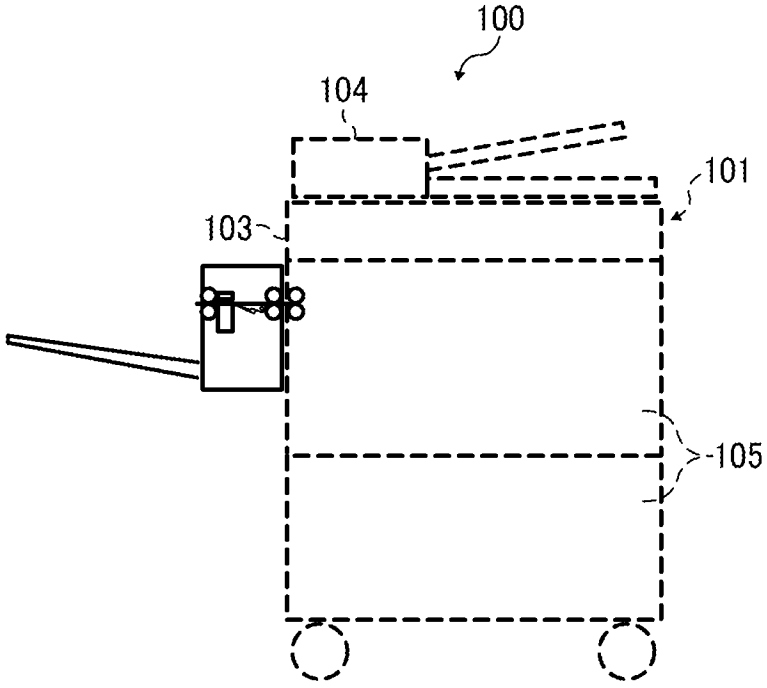
FIGS. 1A and 1B are schematic diagrams illustrating two states of an image forming system according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the term "sheet" used in this specification includes recording media sheets.

Referring now to the drawings, wherein like reference numerals designate identical or corresponding parts throughout the several views thereof, and particularly to FIG. 1, a system including an image forming apparatus and a sheet processing apparatus according to an embodiment of the present invention is described.

Figure 1A:
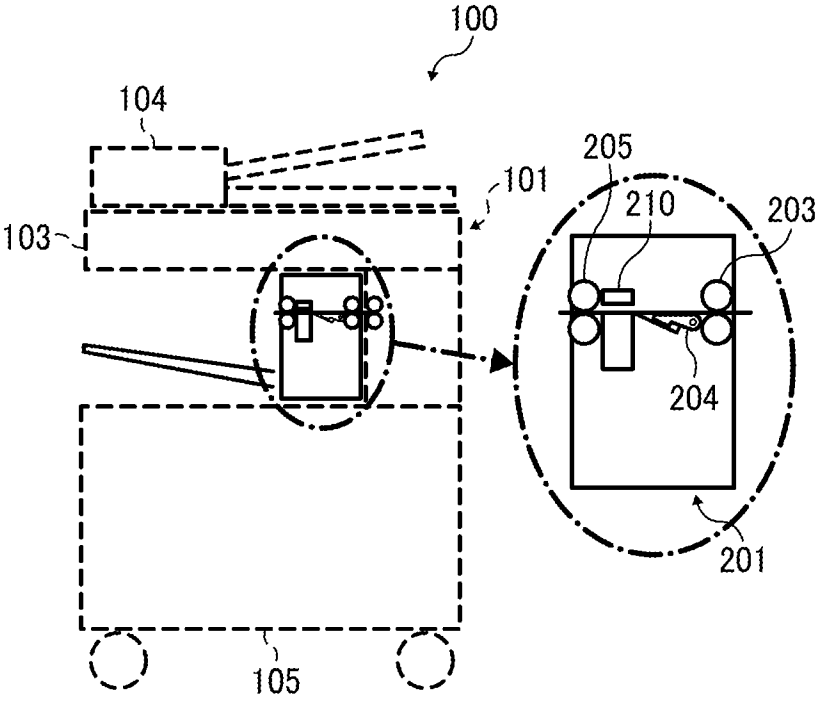

FIGS. 1A and 1B are schematic diagrams illustrating two states of an image forming system according to an embodiment of the present invention. An image forming system 100 according to the present embodiment includes an image forming apparatus 101 and a sheet processing apparatus (i.e., a finisher or post-processing apparatus) 201. The sheet processing apparatus 201 includes a sheet binding mechanism and disposed inside a conveyance channel through which sheets are output from the image forming apparatus 101. Thus, the sheet processing apparatus 201 is a channel-internal binding apparatus. The sheet processing apparatus 201 is disposed inside the conveyance channel of the image forming apparatus 101 in FIG. 1A and outside the conveyance channel in FIG. 1B.

The sheet processing apparatus 201 has two capabilities, aligning sheets stacked inside the conveyance channel and stapling the sheets inside the conveyance channel. In FIG. 1A, the sheet processing apparatus 201 processes sheets inside the housing of the image forming apparatus 101 and thus is also called a housing-internal processing device. Thus, the sheet processing apparatus 201 according to the present embodiment is compact and can be mounted inside the housing or to a side of the image forming apparatus 101 in accordance with the configuration thereof.

The image forming apparatus 101 includes an image forming engine 105, an image reader 103 to read and convert images into image data, and an automatic document feeder (ADF) 104. The image forming engine 102 includes an image processing unit and a sheet feeder. In the state shown in FIG. 1A, a discharge tray to which sheets on which images are formed are output is formed inside the housing of the image forming apparatus 101. In the state shown in FIG. 1B, the discharge tray is positioned outside the image forming apparatus 101.

Figure 2:
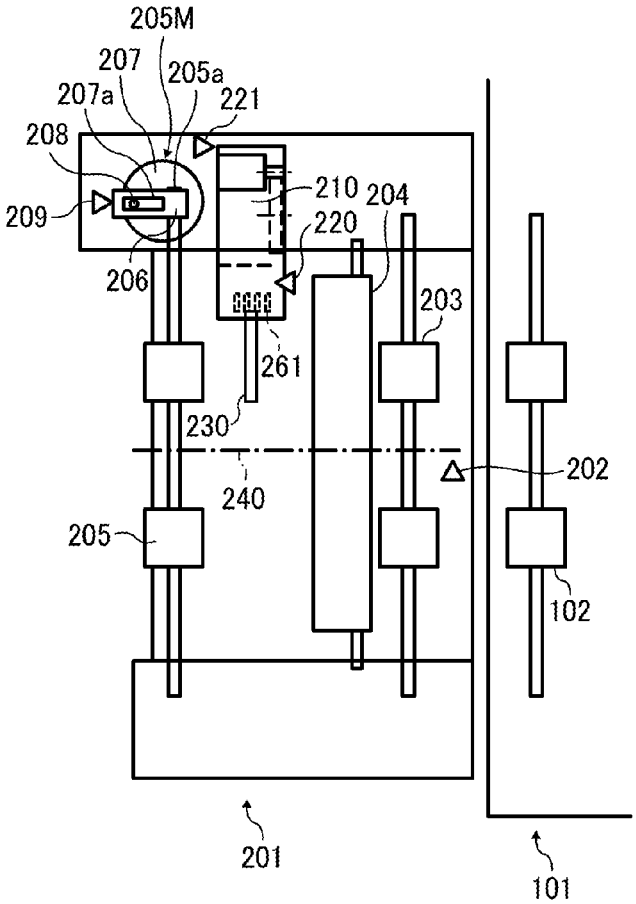
FIG. 2 is a plan view of a sheet processing apparatus shown in FIGS. 1A and 2B.
Figure 3:
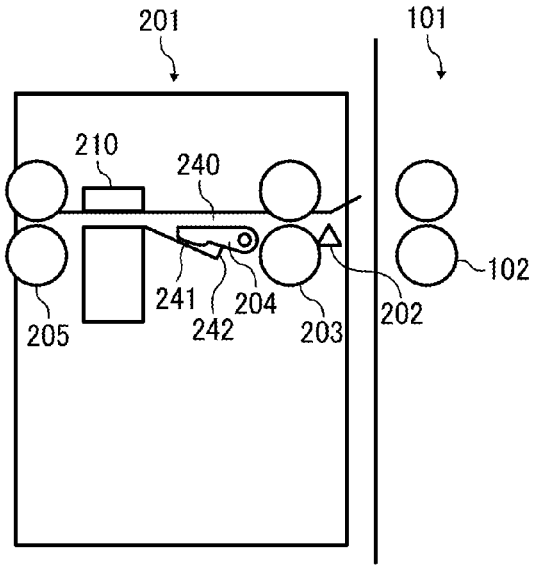
FIG. 3 is a front view of the sheet processing apparatus shown in FIGS. 1A and 1B.

FIGS. 2 and 3 are respectively a plan view and a front view of the sheet processing apparatus 201 shown in FIGS. 1A and 2B. In the configuration shown in FIGS. 2 and 3, the sheet processing apparatus 201 includes an entry detector 202, a pair of entrance rollers 203, a branch pawl 204, a binding device 210, and a pair of discharge rollers 205, and these components are arranged in that order from an entrance side along a conveyance channel 240. The entry detector 202 detects the presence of a sheet received in the sheet processing apparatus 201 after discharged from the image forming apparatus 101. Specifically, the entry detector 202 detects the leading end and the trailing end of the sheet. For example, the entry detector 202 can be a reflection type photosensor. Alternatively, a transmission-type photosensor may be used. The entrance rollers 203 are positioned at the entrance of the sheet processing apparatus 201 to receive sheets discharged by discharge rollers 102 of the image forming apparatus 101 and forward the sheets to the binding device 210. Additionally, a drive source, such as a drive motor, is provided for the entrance rollers 203. A central processing unit (CPU) 201-1 shown in FIG. 20, serving as a controller, controls the stop, rotation, and a conveyance amount of the drive source. The entrance rollers 203 correct skew of the sheet with the leading end of the sheet stuck in a nip between the entrance rollers 203.

The branch pawl 204 is disposed downstream from the entrance rollers 203 in the direction in which the sheet is transported (hereinafter "sheet conveyance direction"). The branch pawl 204 guides the trailing end of the sheet to a bifurcation channel 241. In this case, after the trailing end of the sheet passes by the branch pawl 204, the branch pawl 204 pivots clockwise in FIG. 3, thereby transporting the sheet in reverse. Thus, the trailing end of the sheet is led to the bifurcation channel 241. The branch pawl 204 can pivot driven by a solenoid 250 shown in FIG. 4, which is described in further detail later. Instead of the solenoid 250, a motor may be used. When the branch pawl 204 pivots counterclockwise in FIG. 3, the branch pawl 204 can press a single sheet or multiple sheets against a conveyance face of the bifurcation channel 241. Thus, the branch pawl 204 can retain the single or multiple sheets not to move in the bifurcation channel 241.

The discharge rollers 205 are disposed immediately upstream from the exit of the conveyance channel 240 of the sheet processing apparatus 201. The discharge rollers 205 transport, shift, and discharge the sheets. A drive source for the discharge rollers 205 is provided similarly to the entrance rollers 203, and the controller controls the stop, rotation, and a conveyance amount thereof. A shift mechanism 205M (shown in FIG. 2) shifts the discharge rollers 205. The shift mechanism 205M includes a shift link 206, a shift cam 207, a cam stud 208, and a home position (HP) detector 209.

The entrance rollers 203 and the discharge rollers 205 together form a conveyance unit to transport the sheet bundle 272.

The shift link 206 is provided to a shaft end 205*a* of the discharge rollers 205 and receives a force for shifting the discharge rollers 205. The shift cam 207 is a rotary disc-shaped member and includes the cam stud 208. For example, the shaft of the discharge rollers 205 is movably inserted into a shift link slot 207*a* via the cam stud 208, and the discharge rollers 205 are moved in a direction perpendicular to the sheet conveyance direction by rotation of the shift cam 207. Thus, the discharge rollers 205 are shifted. The cam stud 208 is geared to the shift link slot 207*a* and converts the rotational motion of the shift cam 207 to linear movement in the axial direction of the discharge rollers 205. The HP detector 209 detects a position of the shift link 206, and the detected position is deemed a home position of the shift link 206, used as a reference to control rotation of the shift cam 207. The rotation of the shift is controlled by the above-described CPU 201-1.

The binding device 210 includes a sheet end detector 220, a binding home position (HP) detector 221, and a guide rail 230 to guide movement of the binding device 210. The binding device 210 is a so-called stapler to bind together multiple sheets into a sheet bundle although staples are not used in the present embodiment. In the present embodiment, the binding device 210 squeezes sheets using a pair of tooth forms 261 and a pressure applying unit 269 (shown in FIG. 18), thereby deforming the sheets so that fibers thereof tangle each other. This is called clamp binding. There are hand-held staplers to binds sheets using half blanking, lancing, bending, and inserting in addition to clamp binding. Such binding methods without staples reduce consumption of consumables, make recycling easier, and enable shredding of sheet bundles as is. Therefore, with the binding device 210, sheets can be bound together using sheets alone without staples even in sheet processing apparatuses, so-called finishers.

The sheet end detector 220 detects a lateral end of the sheet, and sheets are aligned with reference to the position detected by the sheet end detector 220. The binding HP detector 221 is movable in a sheet width direction perpendicular to the sheet conveyance direction and detects a position of the binding device 210. The home position of the binding device 210 is set to a position not to interfere with a maximum size sheet processed by the image forming system 100. The guide rail 230 guides the binding device 210 so that the binding device 210 can move reliably in the sheet width direction. The guide rail 230 extends in a range to guide the binding device 210 moving in the direction perpendicular to the conveyance channel 240 (sheet conveyance direction) from the home position to a position to binds a smallest sheets processed by the image forming system 100. A shift unit including a drive motor moves the binding device 210 along the guide rail 230.

The conveyance channel 240 extends from the entrance of the sheet processing apparatus 201 to the exit thereof. The bifurcation channel 241 bifurcates from the conveyance channel 240. The sheet is transported in reverse (switchback) and transported from the trailing end to the bifurcation channel 241. The bifurcation channel 241 serves as a stacking channel in which multiple sheets are stacked and aligned. The sheets are transported so that the trailing ends thereof contact a contact face 242 provided at a downstream end of the bifurcation channel 241. Thus, the contact face 242 serves as a reference plane to align the trailing end of the sheets.

In the present embodiment, the pair of tooth forms 261 includes a first tooth form 261*a* (shown in FIG. 18) on the upper side and a second tooth form 261*b*, on the lower side, configured as a set of squeezing members having projections and recesses mating with each other. The first and second tooth forms 261*a* and 261*b* face each other and squeeze the sheets inserted between them for clamp binding.

Figure 4:
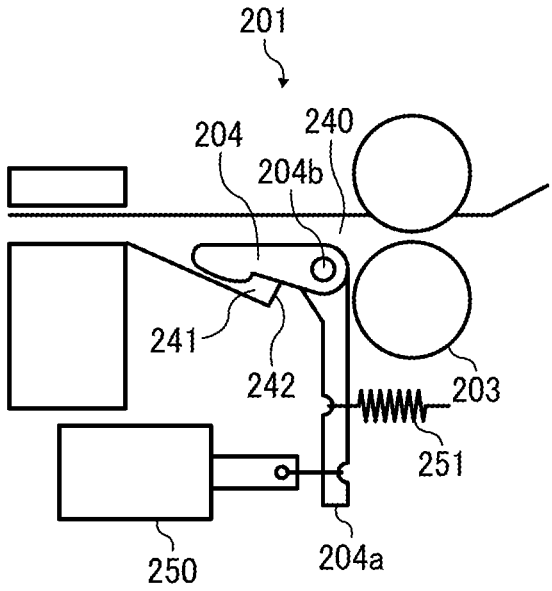
FIG. 4 is a schematic diagram illustrating a main portion of the sheet processing apparatus when a branch pawl is at a position for transporting sheets.
Figure 5:
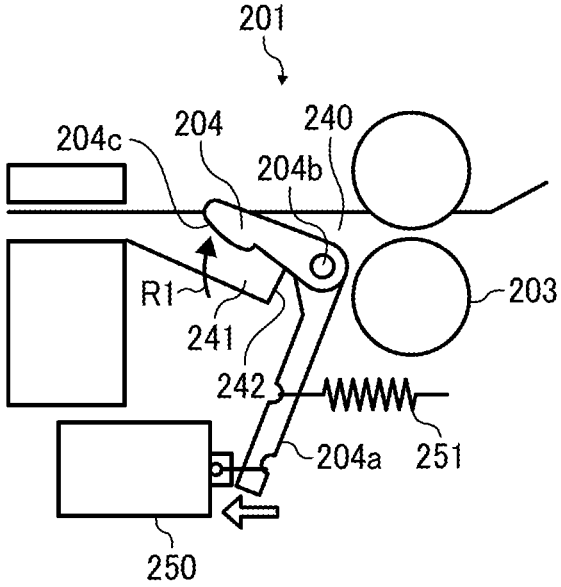
FIG. 5 is a schematic diagram illustrating the main portion of the sheet processing apparatus when the branch pawl is at a position for switchback operation.

FIGS. 4 and 5 are schematic diagram illustrating a main portion around the branch pawl 204 of the sheet processing apparatus 201. FIG. 4 illustrates a state in which the branch pawl 204 forwards the sheet along the conveyance channel 240, and FIG. 5 illustrates switchback operation. The branch pawl 204 is pivotable in a predetermined angle range relative to a support shaft 204*b* to switch the sheet conveyance route between the conveyance channel 240 and the bifurcation channel 241. The position of the branch pawl 204 shown in FIG. 4 serves as a home position to forward the sheet received from the right in FIG. 4 to the downstream side without interfering it. A spring 251 constantly and elastically biases the branch pawl 204 counterclockwise in FIG. 4.

The spring 251 is hooked to a lever 204*a* to which a plunger of the solenoid 250 is connected. It is to be noted that the sheet can be kept clamped inside the bifurcation channel 241 when the branch pawl 204 returns to the position shown in FIG. 4 after the sheet is transported to the branch pawl 204 in the state shown in FIG. 5. The conveyance route can be switched by turning on and off the solenoid 250. Specifically, as the solenoid 250 turns on, the branch pawl 204 rotates in the direction indicated by arrow R1 shown in FIG. 5, blocking the conveyance channel 240 and opening the bifurcation channel 241. Thus, the sheet is led to the bifurcation channel 241.

FIGS. 6A through 14B illustrate online binding operation performed by the binding device 210 of the sheet processing apparatus 201.

Among FIGS. 6A through 14B, the drawings given number with subscript "A" are plan views, and drawings given number with subscript "B" are front views. Additionally, the term "online binding" means that, after the image forming apparatus 101 forms images on the sheets, the sheets are consecutively received by the sheet processing apparatus 201 disposed at the discharge port of the image forming apparatus 101, aligned, and bound thereby. By contrast, the term "independent binding" and "offline binding" mean that the binding device 210 of the sheet processing apparatus 201 binds sheets independently from the image forming apparatus 101, and the sheets thus bound are not limited to those outputs from the image forming apparatus 101. Offline binding is not consecutive with image formation by the image forming apparatus 101.

Figure 6A:
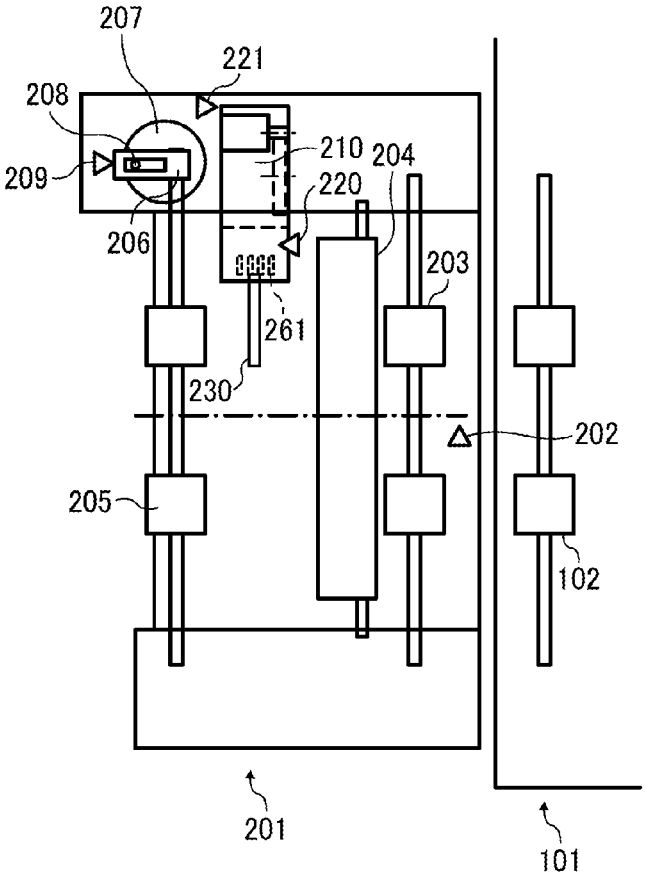
FIGS. 6A and 6B illustrate the sheet processing apparatus being in an initial stage of online binding.
Figure 6B:
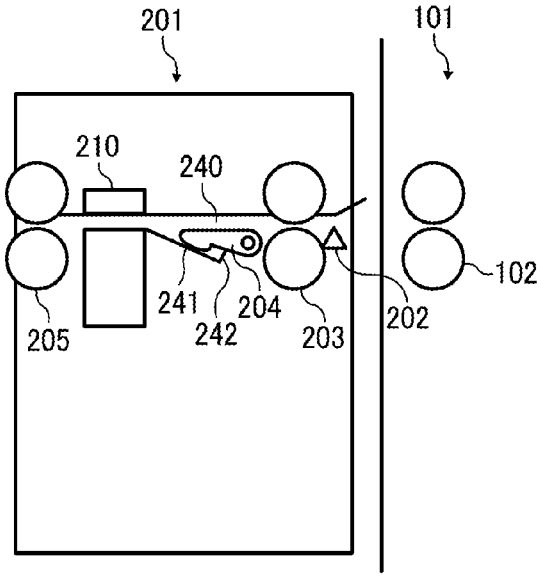

FIGS. 6A and 6B illustrate the sheet processing apparatus 201 being in an initial stage of online binding. Referring to FIGS. 6A and 6B, when the image forming apparatus 101 starts outputting sheets, the respective components of the sheet processing apparatus 201 move to their home positions, thus completing the initial stage.

Figure 7A:
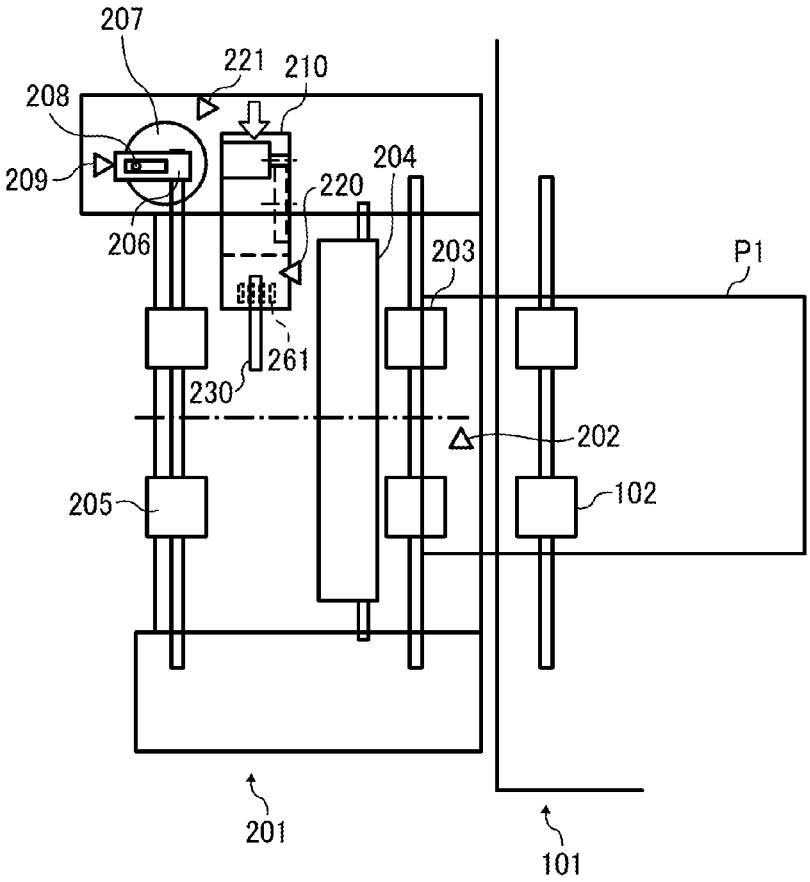
FIGS. 7A and 7B illustrate a state immediately after a first sheet output from an image forming apparatus is received in the sheet processing apparatus.
Figure 7B:
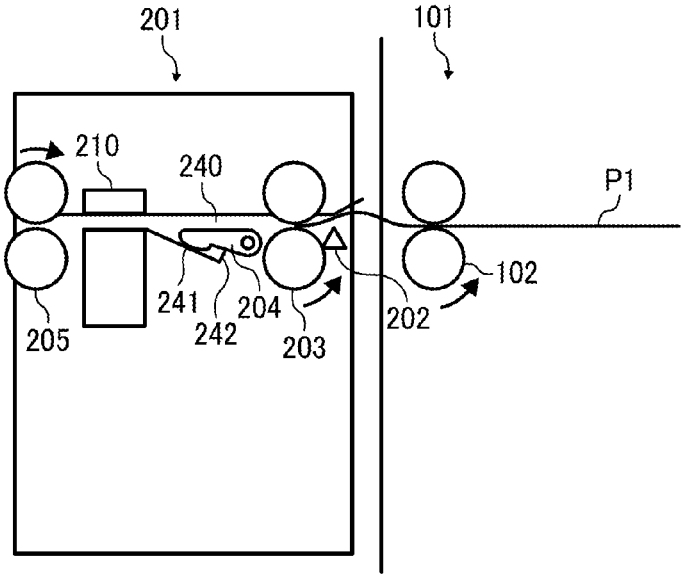

FIGS. 7A and 7B illustrates a state immediately after a first sheet P1 output from the image forming apparatus 101 is received in the sheet processing apparatus 201. Before the first sheet P1 is received by the sheet processing apparatus 201, the CPU of the sheet processing apparatus 201 obtains sheet processing data such as processing type and sheet data (sheet-related variables) and enters a standby state for receiving sheets according to the data.

The processing types include straight transport, shifted discharge, and binding. For the straight transport, the entrance rollers 203 and the discharge rollers 205 start rotating in the sheet conveyance direction in the standby state, and the first sheet P1 through a last sheet Pn are transported sequentially. After the last sheet Pn is discharged, the entrance rollers 203 and the discharge rollers 205 stop. It is to be noted that "n" is an integer equal to greater than "2".

For the shifted discharge, the entrance rollers 203 and the discharge rollers 205 start rotating in the sheet conveyance direction in the standby state. In the shifted discharge, after the trailing end of the first sheet P1 exits from the entrance rollers 203, the shift cam 207 rotates a predetermined amount, and the discharge rollers 205 move in the axial direction. At that time, the first sheet P1 moves together with the discharge rollers 205. After the first sheet P1 is discharged, the shift cam 207 rotates to the home position and is prepared for the subsequent sheet. This shifting operation is repeated until the last sheet Pn of that copy (a bundle) is discharged. Thus, a bundle of sheets, to be bound into a sheet bundle 272, is stacked, shifted to one side. When a first sheet P1 of a subsequent copy is received, the shift cam 207 rotates in the direction reverse to the direction for the previous copy.

For binding, in the standby state, the entrance rollers 203 are motionless, and the discharge rollers 205 start rotating in the sheet conveyance direction. Additionally, the binding device 210 moves to a standby position withdrawn a predetermined amount from the sheet width and goes standby. In this case, the entrance rollers 203 also serve as a pair of registration rollers. Specifically, the first sheet P1 is received in the sheet processing apparatus 201. Then, the leading end of the sheet is detected by the entry detector 202 and gets stuck in the nip between the entrance rollers 203. Further, with the leading end thereof stuck in the entrance rollers 203, the first sheet P1 is transported by the discharge rollers 102 of the image forming apparatus 101 by an amount to cause slackening. Subsequently, the entrance rollers 203 start rotating. Thus, skew of the first sheet P1 is corrected. FIGS. 7A and 7B illustrate this state.

Figure 8A:
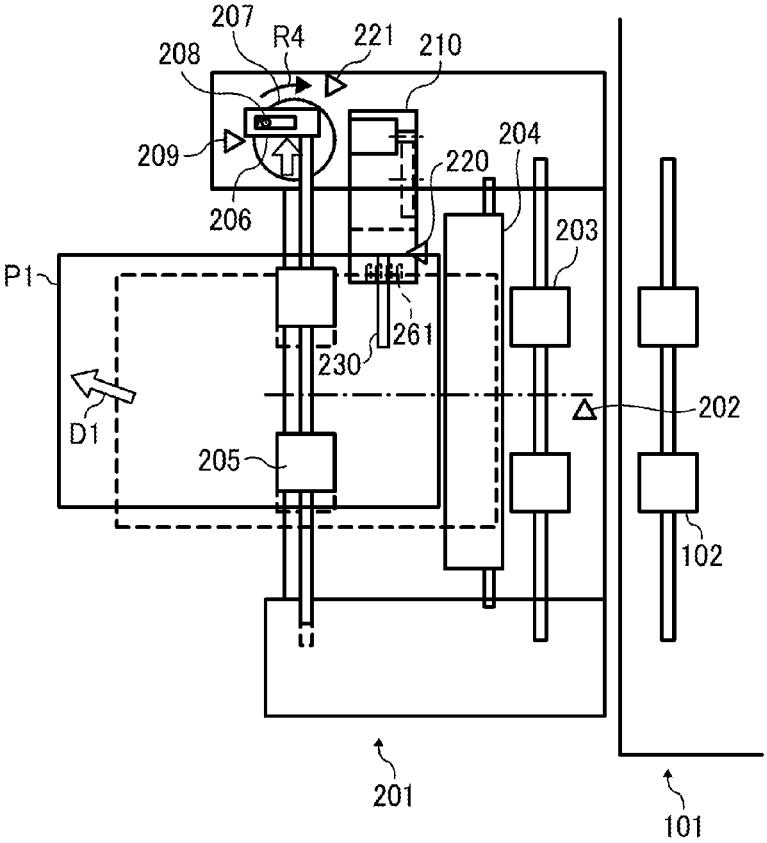
FIGS. 8A and 8B illustrate a state in which the trailing end of the sheet released from a nip between a pair of entrance rollers is beyond a bifurcation channel.
Figure 8B:
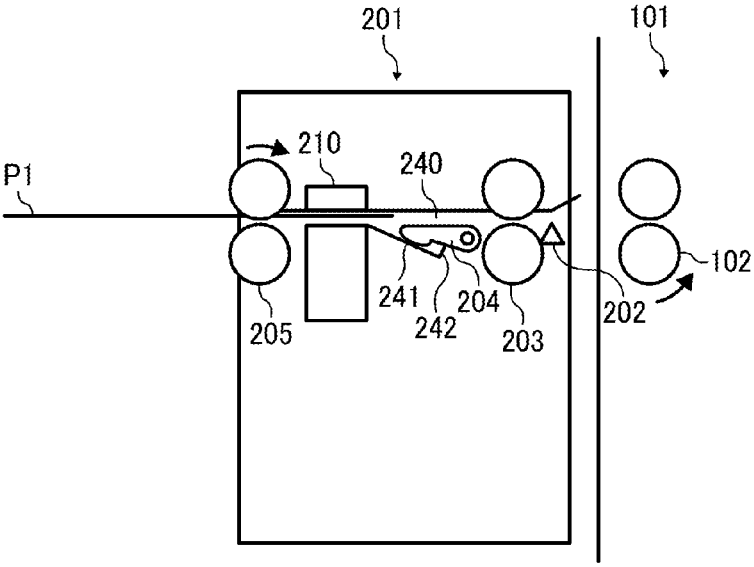

FIGS. 8A and 8B illustrates a state in which the trailing end of the sheet is released from the nip between the entrance rollers 203 and gets beyond the bifurcation channel 241. The conveyance amount of the first sheet P1 is measured based on the detection of the trailing end of the sheet by the entry detector 202, and thus the CPU 201-1 of the sheet processing apparatus 201 recognizes the position of the first sheet P1.

After the trailing end of the sheet passes by the nip between the entrance rollers 203, the entrance rollers 203 stop rotating to receive the second sheet P2. Simultaneously, the shift cam 207 rotates in the direction indicated by arrow R4 shown in FIG. 8A (clockwise in FIG. 8A). The discharge rollers 205 start moving in the axial direction with the first sheet P1 retained in the nip thereof. Thus, the first sheet P1 is transported while being moved obliquely as indicated by arrow D1 in FIG. 8A, obliquely to the sheet conveyance direction. Subsequently, when the sheet end detector 220, disposed adjacent to or incorporated in the binding device 210, detects the lateral end of the sheet P, the shift cam 207 stops and rotates in reverse. Then, the shift cam 207 stops in a state in which the sheet end detector 220 does not detect the presence of the sheet P. When the trailing end of the sheet P reaches a predetermined position beyond a leading end of the branch pawl 204, the discharge rollers 205 stop.

Figure 9A:
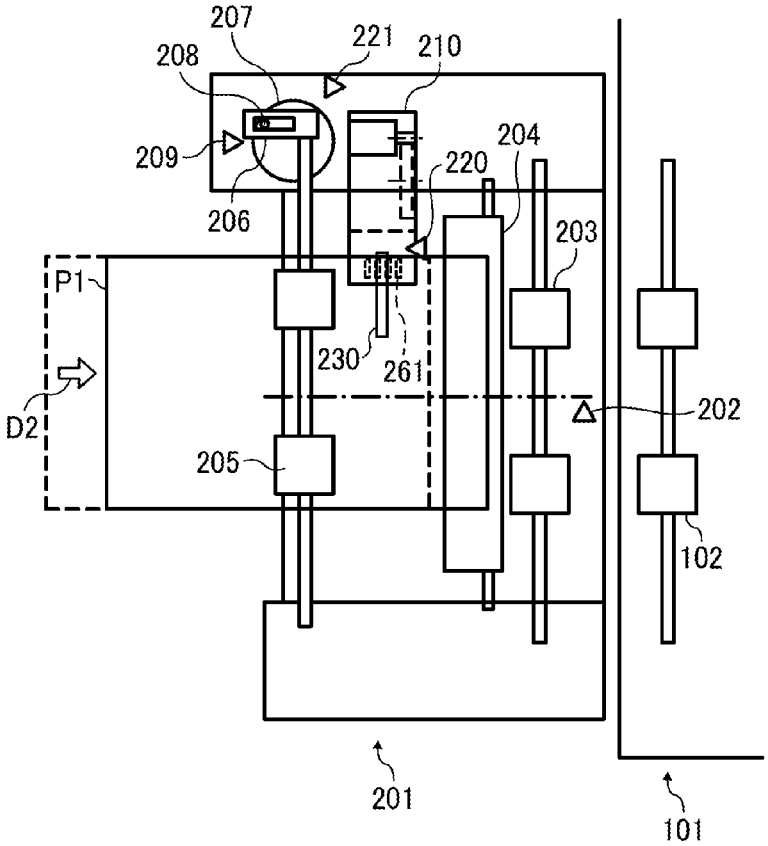
FIGS. 9A and 9B illustrate the switchback operation for changing a conveyance route in which the sheet is transported.
Figure 9B:
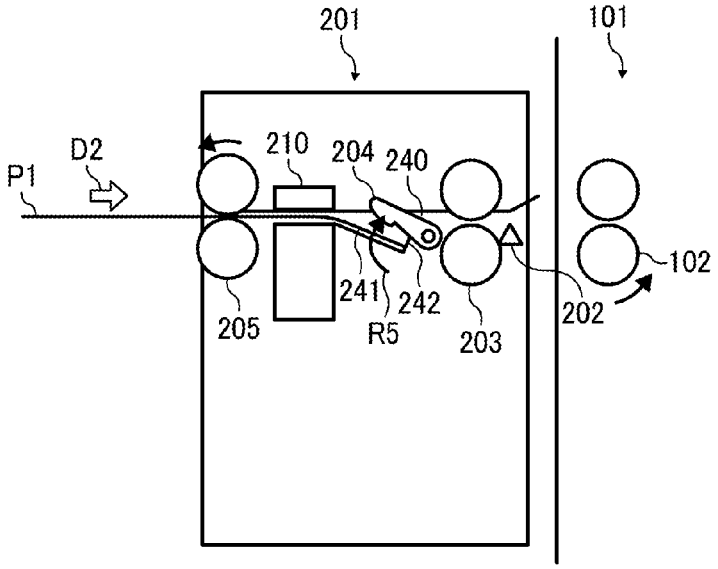

FIGS. 9A and 9B illustrate the switchback operation for changing the conveyance route in which the sheet P1 is transported. Subsequent to the state shown in FIGS. 8A and 8B, the branch pawl 204 is rotated in the direction indicated by arrow R5 shown in FIG. 9B to switch the conveyance route to the bifurcation channel 241, after which the discharge rollers 205 are rotated in reverse. With this operation, the first sheet P1 is switchbacked in the direction indicated by arrow D2 (hereinafter "direction D2"), and the trailing end of the first sheet P1 enters the bifurcation channel 241. Further, the trailing end of the sheet contacts the contact face 242 and is aligned with reference to the contact face 242. When the first sheet P1 is thus aligned, the discharge rollers 205 stop. At that time, the discharge rollers 205 slip as the trailing end of the first sheet P1 contacts the contact face 242 so as not to apply conveyance force thereto. In other words, the discharge rollers 205 no longer buckle the first sheet P1 after the trailing end of the switchbacked first sheet P1 is aligned by the contact face 242.

Figure 10A:
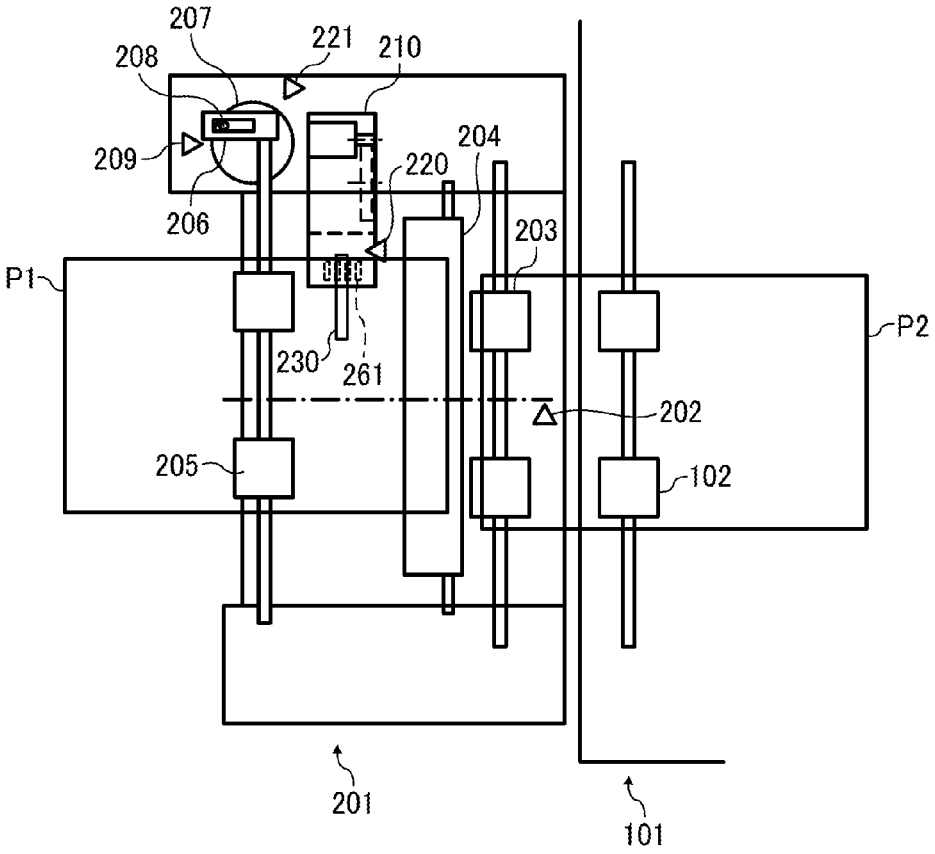
FIGS. 10A and 10B illustrate a state in which the first sheet is retained in the bifurcation channel, and a second sheet is received in the sheet processing apparatus.
Figure 10B:
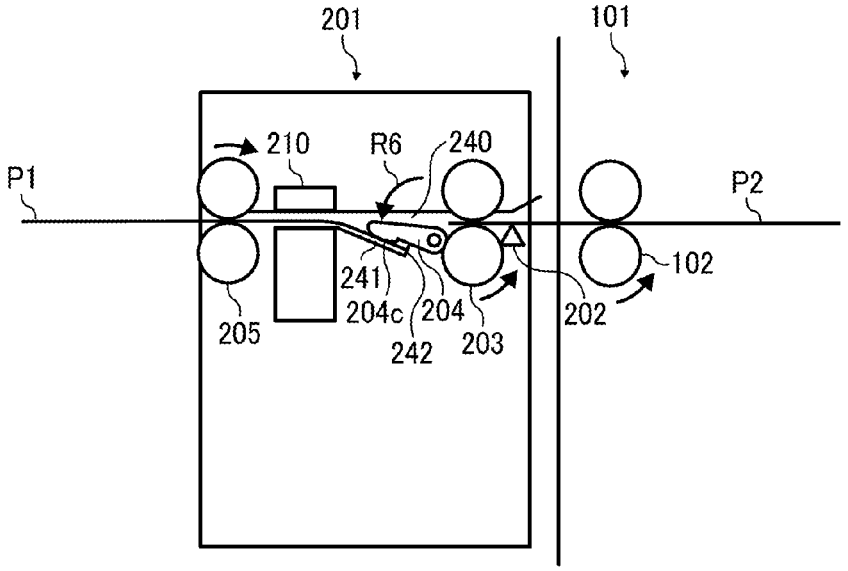

FIGS. 10A and 10B illustrate a state in which the first sheet P1 is retained in the bifurcation channel 241, and the second sheet P2 is received in the sheet processing apparatus 201. After the preceding first sheet P1 is aligned by the contact face 242, the branch pawl 204 rotates in the direction indicated by arrow R6 shown in FIG. 10B. With this operation, a lower face 204*c* (hereinafter "pressing face 204*c*") of the branch pawl 204 presses the trailing end of the sheet, which is positioned in the bifurcation channel 241, against a lower face of the bifurcation channel 241 to keep the first sheet P1 from moving. When the second sheet P2 is received from the image forming apparatus 101, the entrance rollers 203 correct skew thereof similarly to the first sheet P1. Subsequently, the entrance rollers 203 and the discharge rollers 205 start rotating in the sheet conveyance direction simultaneously.

Figure 11A:
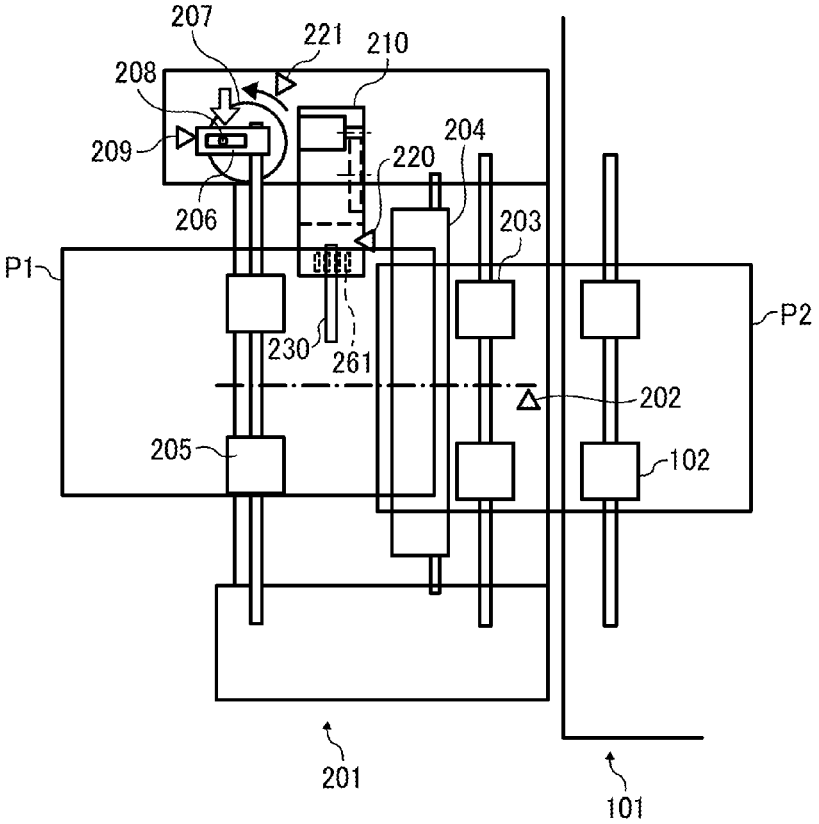
FIGS. 11A and 11B illustrate a state in which the second sheet is received in the sheet processing apparatus.
Figure 11B:
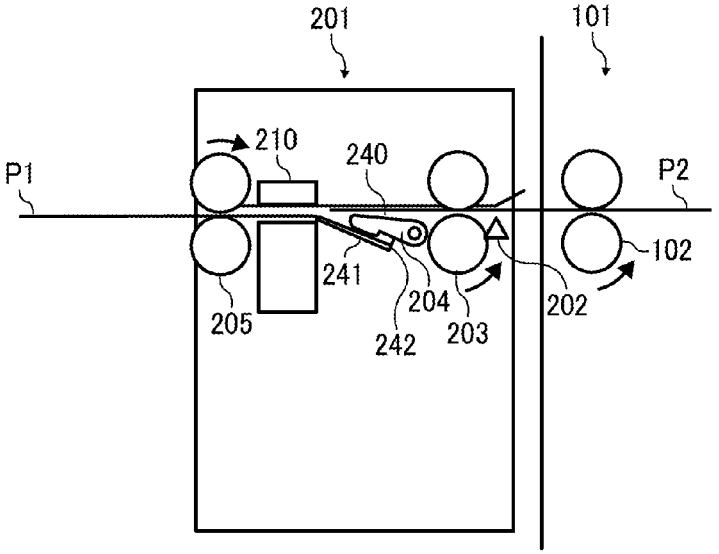

FIGS. 11A and 11B illustrate a state in which the second sheet P2 is received in the sheet processing apparatus 201. After the state shown in FIGS. 10A and 10B, as the subsequent sheets P3 through Pn are transported from the image forming apparatus 101, operations shown in FIGS. 10A through 11B are executed to sequentially transport the sheets P to a predetermined position and align the sheets P there. Thus, a sheet bundle 272 is stacked in the conveyance channel 240.

Figure 12A:
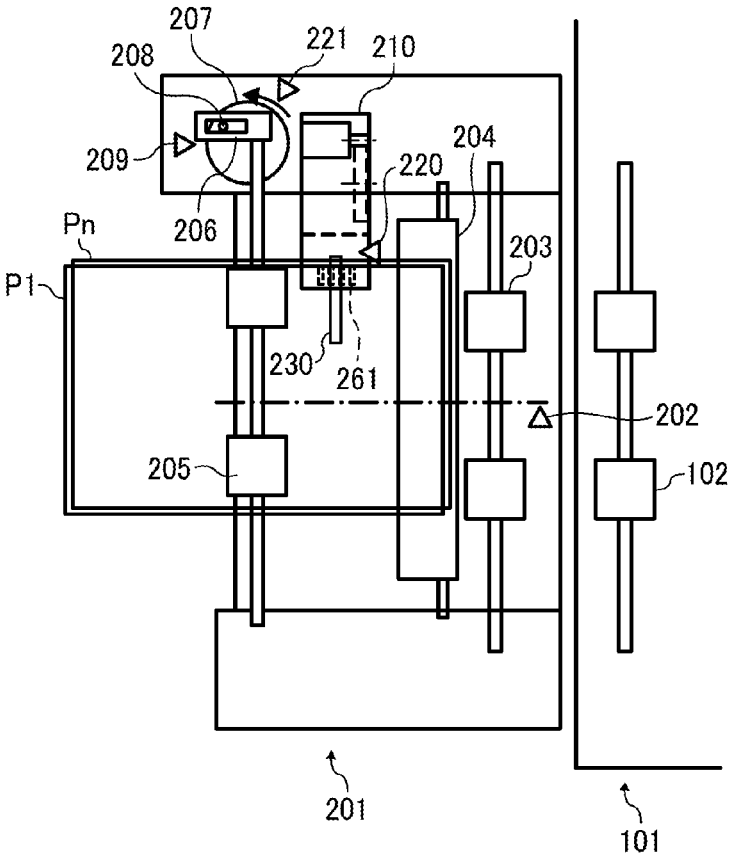
FIGS. 12A and 12B illustrate a state in which a last sheet is aligned with the preceding sheets, forming a sheet bundle.
Figure 12B:
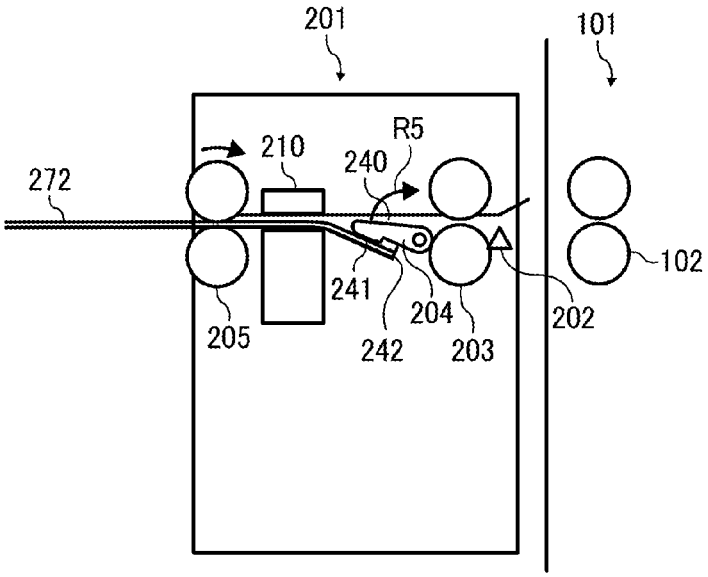

FIGS. 12A and 12B illustrate a state in which the last sheet Pn is aligned with the preceding sheets P, forming the sheet bundle 272. After the last sheet Pn is aligned and the sheet bundle 272 is formed, the discharge rollers 205 are rotated a predetermined amount in the sheet conveyance direction. This operation can eliminate the slackening of the sheet P caused when the trailing end of the sheet P contacts the contact face 242. Subsequently, the branch pawl 204 rotates in the direction indicated by arrow R5 to disengage the pressing face 204*c* from the bifurcation channel 241, thereby canceling the pressure applied to the sheet bundle 272. Thus, the sheet bundle 272 is released from the branch pawl 204 and can be transported by the discharge rollers 205.

Figure 13A:
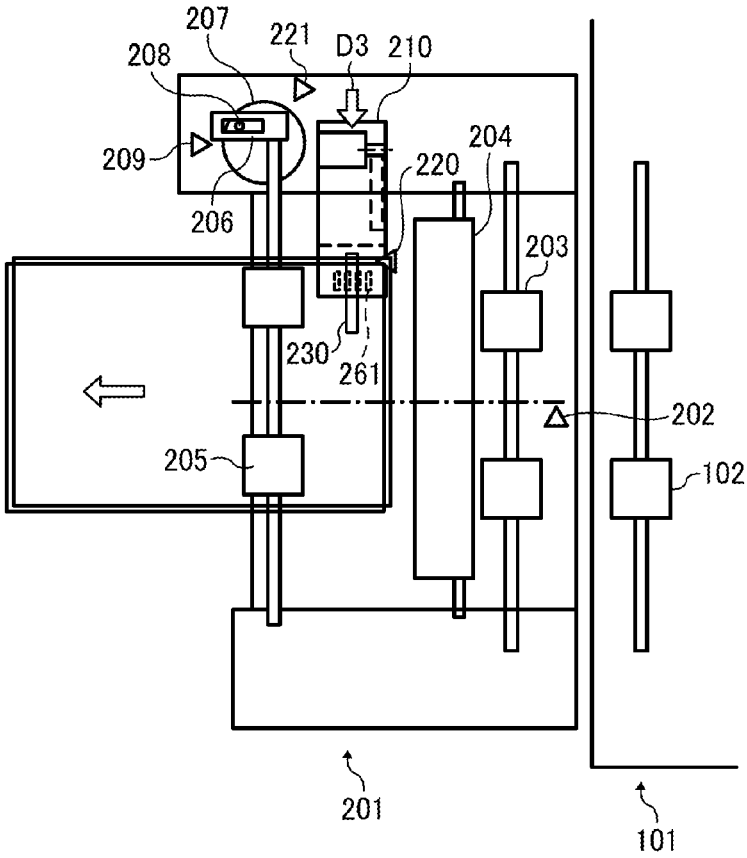
FIGS. 13A and 13B illustrate binding operation subsequent to the state shown in FIGS. 12A and 12B.
Figure 13B:
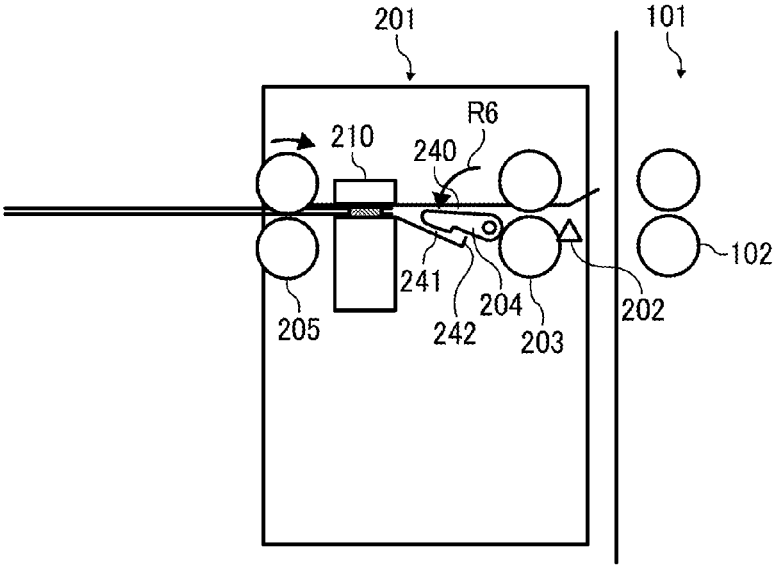

FIGS. 13A and 13B illustrate binding operation. After the state shown in FIGS. 12A and 12B, the discharge rollers 205 rotate in the sheet conveyance direction and stop when a binding position in the sheet bundle 272 reaches the pair of tooth forms 261 of the binding device 210. Thus, the binding position in the sheet bundle 272 is aligned with the position of the tooth forms 261 in the sheet conveyance direction. Additionally, the binding device 210 is moved in the direction indicated by arrow D3 shown in FIG. 13A (hereinafter "direction D3 or sheet width direction"), perpendicular to the sheet conveyance direction, until the pair of tooth forms 261 is aligned with the binding position in the sheet bundle 272 in the sheet width direction.

Accordingly, the binding position in the sheet bundle 272 is aligned with the tooth forms 261 in the sheet conveyance direction as well as the width direction. Then, the branch pawl 204 rotates in the direction indicated by arrow R6 shown in FIG. 13B and returns to the state for receiving the subsequent sheet P. Subsequently, the drive motor 265 is turned on, and the pair of tooth forms 261 squeezes the sheet bundle 272, thereby binding the sheet bundle 272 (i.e., clamp binding or squeezing and binding). It is to be noted that, although the description above concerns the binding device 210 employing clamp binding, other type of binding, for example, half blanking, lancing, and bending and inserting can be used instead.

Figure 14A:
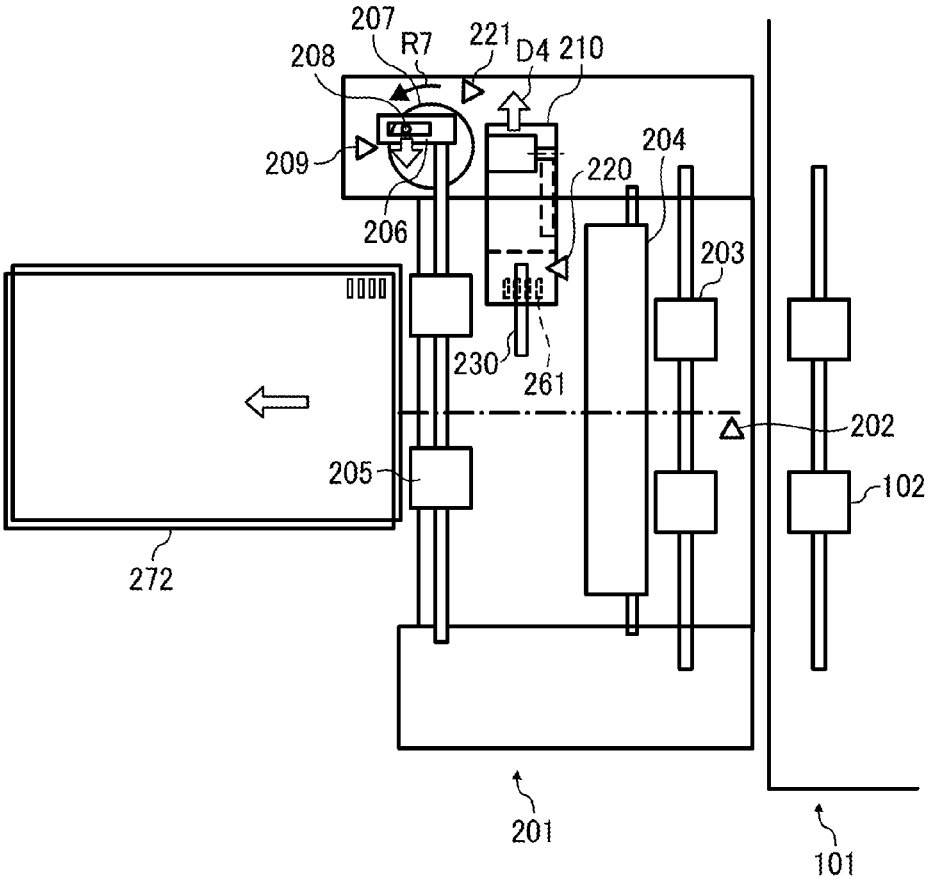
FIGS. 14A and 14B illustrate a state in which the sheet bundle is discharged.
Figure 14B:
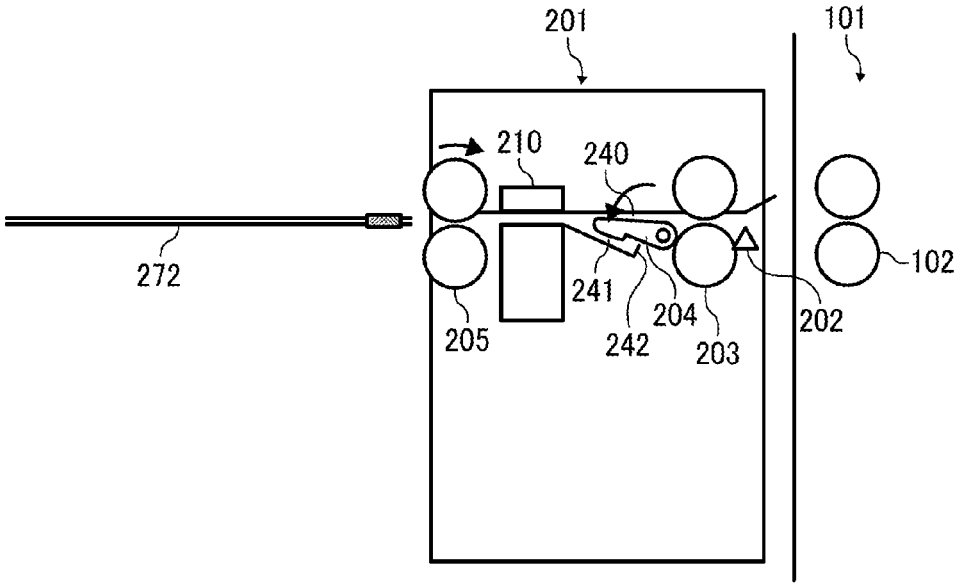

FIGS. 14A and 14B illustrate a state in which the sheet bundle 272 is discharged. After the sheet bundle 272 is bound together as shown in FIGS. 13A and 13B, the discharge rollers 205 rotate to discharge the sheet bundle 272. After the sheet bundle 272 is discharged, the shift cam 207 rotates in the direction indicated by arrow R7 shown in FIG. 14A to the home position (shown in FIG. 6A). In parallel to this operation, the binding device 210 moves in the direction indicated by arrow D4 shown in FIG. 14A to the home position shown in FIGS. 6A and 6B. Thus, alignment and binding of a single copy of sheets (a bundle of sheets) is completed. The operations shown in FIGS. 6A through 14B are repeated for binding subsequent copies, if any.

Before a distinctive feature of the present embodiment is described, a binding device according to a comparative example is described.

Figure 15:
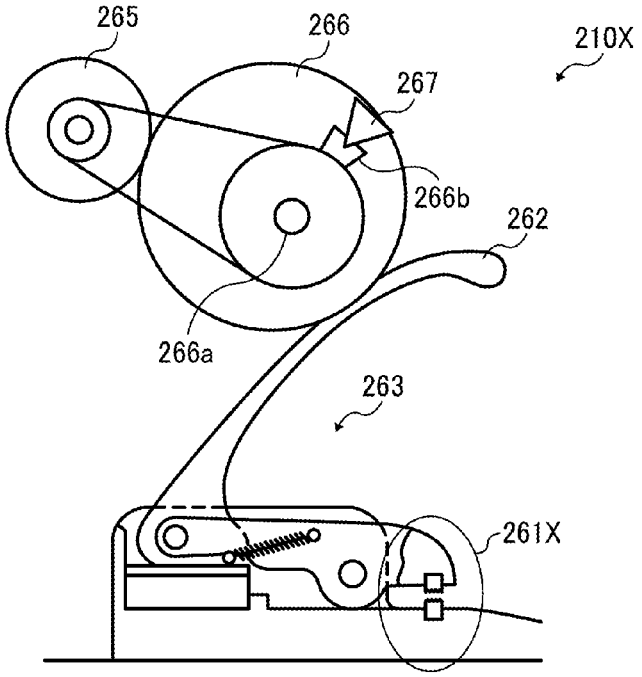
FIG. 15 is a schematic view of a binding device according to a comparative example, being at a position for receiving sheets.
Figure 16:
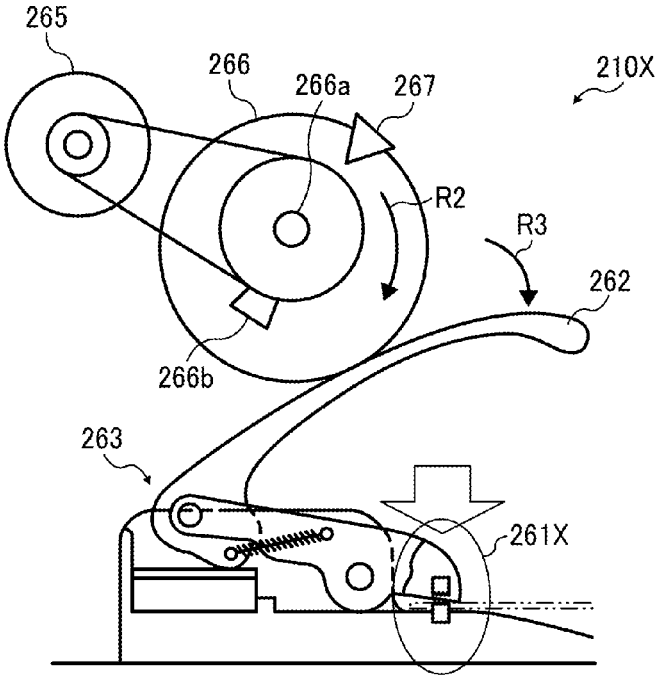
FIG. 16 is a schematic view of the comparative binding device shown in FIG. 15, being at a position for binding sheets.

FIGS. 15 and 16 illustrate a binding device 210X according to a comparative example. Referring to FIGS. 15 and 16, a binding device 210X includes a pair of tooth forms 261X, a pressure lever 262, a group of links 263, a drive motor 265, an eccentric cam 266, and a cam home position (HP) detector 267. The pair of tooth forms 261X are disposed vertically in pair and shaped to engage each other. The pair of tooth forms 261X is positioned at an output end of the group of links 263 combined together, and the pressure lever 262 is positioned at an input end (driving end) of the group of links 263. The tooth forms 261X engage and are disengaged from each other as the pressure lever 262 applies pressure to and release the pressure.

The pressure lever 262 is rotated by the eccentric cam 266. The drive motor 265 drives the eccentric cam 266, and the rotational position thereof is controlled with reference to detection by the cam HP detector 267. The rotational position of the eccentric cam 266 defines the distance from a rotation axis 266*a* and to a cam surface thereof, based on which the pressing amount by the pressure lever 262 is determined. The home position of the eccentric cam 266 is set to a position at which a feeler 266*b* provided to the eccentric cam 266 is detected by the cam HP detector 267. As shown in FIG. 15, when the eccentric cam 266 is at the home position, the tooth forms 261X are disengaged from each other. In this state, binding is not feasible and sheets can be received in the binding device 210.

For binding sheets, the sheets are inserted between the tooth forms 261X at the position shown in FIG. 15, and then the drive motor 265 rotates. When the drive motor 265 starts rotating, the eccentric cam 266 rotates in the direction indicated by arrow R2 shown in FIG. 16. As the eccentric cam 266 rotates, the cam surface thereof shifts, and the pressure lever 262 rotates in the direction indicated by arrow R3 shown in FIG. 16. The force of rotation increases in strength through the group of links 263 using leverage and is transmitted to the pair of tooth forms 261X at the output end.

When the eccentric cam 266 rotates a predetermined amount, the upper and lower tooth forms 261X engage each other, thus squeezing the sheets interposed therebetween. The squeezed sheets deform, and fibers of adjacent sheets tangle each other. Subsequently; the drive motor 265 rotates in reverse and stops in response to a detection result generated by the cam HP detector 267. Then, the upper and lower tooth forms 261X return to the state shown in FIG. 15 and become capable of transporting the sheets. The pressure lever 262 has a capability of spring and can deform to let an excessive load out when the excessive load is applied thereto.

As described above, in the present embodiment, the sheet bundle is squeezed and clamped to bind the sheet bundle. Conventionally, a force of about 1000 N is applied to squeeze and bond together the sheets. It the configuration shown in FIGS. 15 and 16, such a force can be given by the drive motor 265. However, driving the sheet binding device with a large driving force is not desirable from a viewpoint of energy saving.

In view of the foregoing, the sheet processing apparatus according to the present embodiment includes the sheet binding device in which a pair of squeezing members includes projections and recesses, and a pressure applying unit applies pressure to the squeezing members in a direction of thickness of a sheet bundle interposed between the squeezing members. The pressure applying unit generates a pressing force between the squeezing members such that the pressing force increases as the relative distance between the squeezing members decreases. According to the present embodiment, an energy-saving sheet binding device driven by a reduced driving force, saving energy, can be attained. It is to be noted that other aims, configurations, and effects of the present embodiment are also given in the description below.

Figure 17:
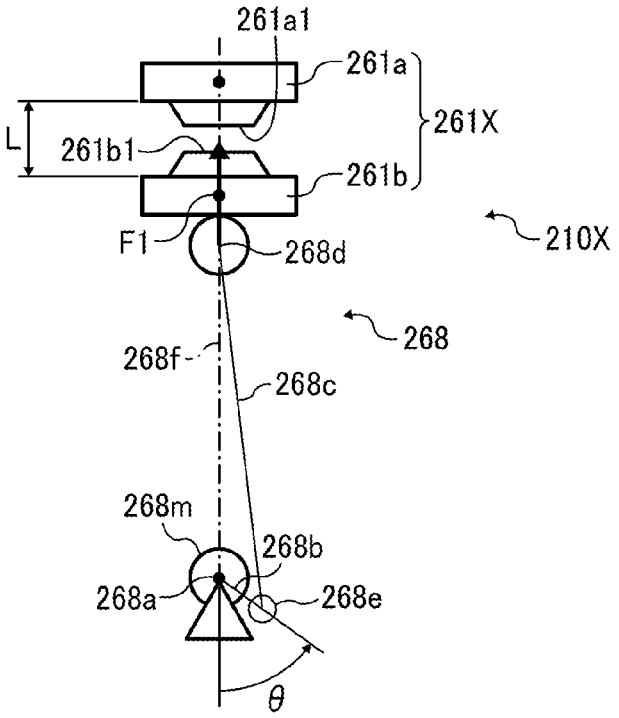
FIG. 17 illustrates a pressure applying unit according to another comparative example.

FIG. 17 is a partial diagram of another comparative sheet binding device 210X that employs a crank mechanism 268 as a pressure applying unit to press a pair of tooth forms 261X.

In FIG. 17, the tooth forms 261X (i.e., first and second forms 261*a* and 261*b*) are disposed facing each other, and the sheet bundle is inserted therebetween. The crank mechanism 238 includes a connecting rod 268*c*, and an end of the connecting rod 268*c* is rotatably or pivotably connected via a joint 268*d* to a side of the second tooth form 261*b* opposite a teeth face 261*b*1. The other end (i.e., a base end) of the connecting rod 268*c* is connected to a rotary shaft 268*a* of a drive motor 268*m* serving as a drive source. An end of a rotary member 268*b* that rotates together with the rotary shaft 268*a* serves as a joint 268*e* to which the connecting rod 268*c* is connected rotatably.

When the drive motor 268*m* rotates in the direction indicated by arrow θ shown in FIG. 17, the second tooth form 261*b* can be moved back and forth along a line 268*f* by the connecting rod 268*c*, guided by a guide member. The sheet bundle is disposed in a clearance L between the first and second tooth forms 261*a* and 261*b* and squeezed as the second tooth form 261*b* reciprocates. The rotary shaft 268*a* of the drive motor 268*m* is positioned on an extension line of the linear movement of the straight line (extension of the line 2680. A point F1 on which an action of the connecting rod 268*c* is exerted is also positioned on the extension line of the line 268*f*.

When such a pressure applying unit is used, the sheet bundle is squeezed prior to being bound, and accordingly this method can be also called "squeezing and clamp binding".

Figure 18:
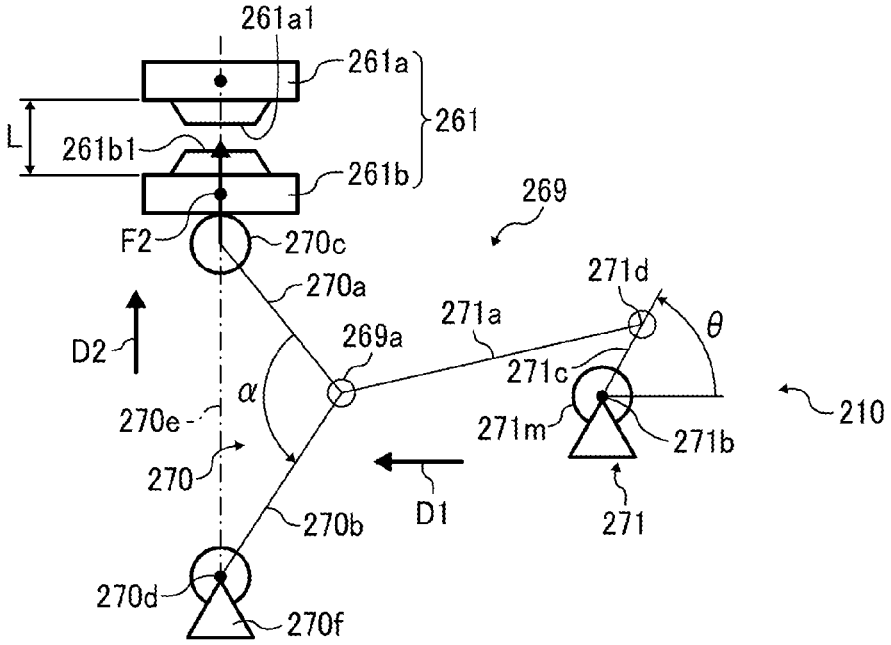
FIG. 18 illustrates a pressure applying unit according to an embodiment.

FIG. 18 is partial diagram of the binding device 210 according to the present embodiment, in which a squeezing and clamping unit 269 serves as a pressure applying unit.

Referring to FIG. 18, the squeezing and clamping unit 269 includes a link unit 270 and a crank unit 271 serving as a link activation unit. The link unit 270 and the crank unit 271 are rotatably connected to each other via a first joint 269*a*.

The link unit 270 includes first and second connecting rods 270*a* and 270*b*, and a first end of each of the first and second connecting rods 270*a* and 270*b* is connected to the first joint 269*a*. A second end the first connecting rod 270*a* is connected to a second joint 270*c*, and that of the second connecting rod 270*b* is connected to a third joint 270*d*. The second joint 270*c* is disposed on a back side of the second tooth form 261*b*, and the third joint 270*d* is fixed to a stationary member 270*f* not to move. The stationary member 270*f* is on a straight line 270*e* that is similar to the line 268*f* in FIG. 17. The straight line 270*e* can be a locus along which the second tooth form 261*b* moves, guided by a guide.

The crank unit 271 includes a third connecting rod 271*a*, a drive motor 271*m*, and a rotary member 271*c* fixed to a rotary shaft 271*b* of the drive motor 271*m* movably together with the rotary shaft 271*b*, which are respectively similar to the connecting rod 268*c*, the drive motor 268*m*, and the rotary member 268*b* shown in FIG. 17. An end of the third connecting rod 271*a* is rotatably connected to an end of the rotary member 271*c* as well as a fourth joint 271*d*. The other end thereof is rotatably connected to the first joint 269*a*. In other words, one end of each of the first, second, and third connecting rods 270*a*, 270*b*, and 271*a* is connected to the first joint 269*a*. It is to be noted that the position of the rotary shaft 271*b* of the drive motor 271*m* is fixed.

Additionally, the first and second connecting rods 270*a* and 270*b* are connected together such that an angle α therebetween (via the first joint 269*a*) is not 180 degrees, that is, the first and second connecting rods 270*a* and 270*b* are not aligned with each other, when the second tooth form 261*b* is shifted to the first tooth form 261*a* at a maximum. Links connected in this manner may be called "doglegged links or elbow-shaped links".

In the present embodiment, the doglegged link is constructed with a link unit including the first and second connecting rods 270*a* and 270*b* and the first joint 269*a* that connects the first ends of them rotatably. In this configuration, the third connecting rod 271*a* is connected to the first joint 269*a*, and the first joint 269*a* is moved in the direction indicated by arrow D1. (hereinafter "direction D1") and the opposite direction by the rotary member 271*c* driven by the drive motor 271*m*. The respective members are disposed such that a dead point of the first joint 269*a* in the direction D1 at that time is positioned immediate short of the straight line 270*e*.

This configuration can prevent the first and second connecting rods 270*a* and 270*b* from being aligned with each other, and a maximum pressing force can be applied to the tooth forms 261 immediately before the first and second connecting rods 270*a* and 270*b* are aligned with each other. With this configuration, the first joint 269*a* can constantly have a vertical angle, and the link unit is doglegged, and thus called a doglegged link.

In the squeezing and clamping unit 269 configured as described above, as the drive motor 271*m* rotates in the direction θ, the third connecting rod 271*a* pushes the first joint 269*a* in the direction D1. As the first joint 269*a* moves in the direction D1, the angle α between the first and second connecting rods 270*a* and 270*b* increases. By contrast, the second tooth form 261*b* moves in the direction indicated by arrow D2 (hereinafter "direction D2") since the third joint 270*d* is stationary. Then, while moving to the first tooth form 261*a* with the sheet bundle interposed in the clearance L therebetween, the second tooth form 261*b* applies pressing force to the sheet bundle. Thus, clamp binding is executed. It is to be noted that reference character F2 represents a point of action exerted on the second tooth form 261*b* by the first connecting rod 270*a*, and the point F2 is positioned on the extension line of the straight line 270*e*.

In the present embodiment, the link unit 270 is configured to move the second tooth form 261*b* with the doglegged link, and the crank unit 271 transmits a driving force to the link unit 270. As described above, when or almost when the first and second connecting rods 270*a* and 270*b* are fully stretched, the doglegged link can generate a strong force. Therefore, doglegged links are often used in jacks for vehicles. Therefore, the relation between the link unit 270 and the crank unit 271 is set such that, in driving the link unit 270, maximum force can be generated at a preferred timing using the crank unit 271.

Figure 19:
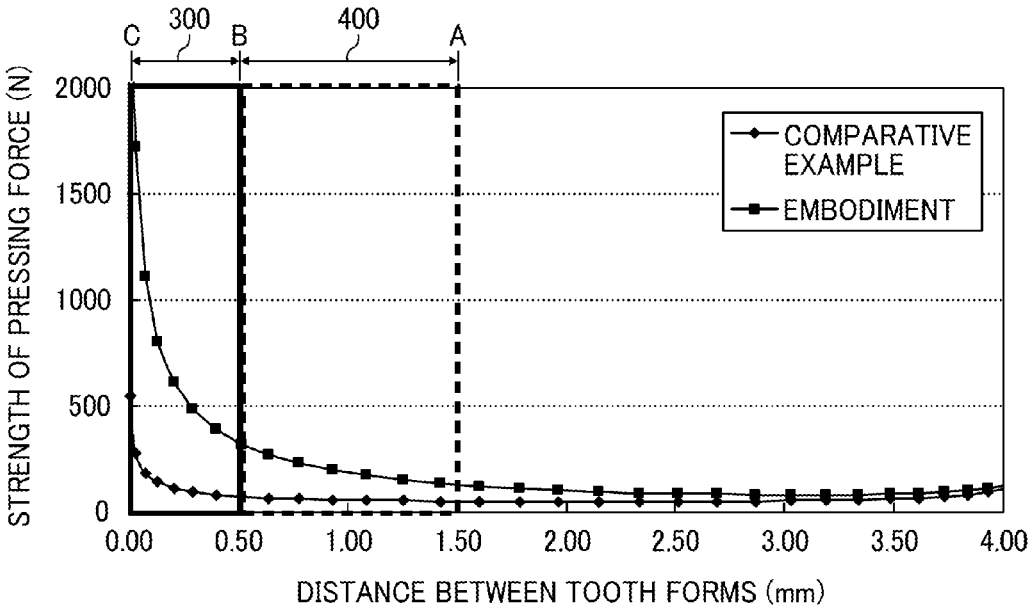
FIG. 19 is a graph illustrating relations between the size of clearance between tooth and force applied to the tooth according to an embodiment and a comparative example.

FIG. 19 is a graph illustrating relations between the size of the clearance L between the tooth forms 261*a* and 261*b* and force applied thereto. In FIG. 19, the comparative configuration shown in FIG. 17, using the crank mechanism alone, is compared with the present embodiment shown in FIG. 18, using the link unit and the crank mechanism in combination.

In FIG. 19, the abscissa represents the size of the clearance L in millimeters (mm) between the tooth forms 261 (also "distance L"), and the ordinate represents the pressing force F in newton (N) applied to the tooth forms 261 when a bundle of five sheets is squeezed and bound. Additionally, at a point B, the distance between the tooth forms 261 equals to the thickness of the sheet bundle, and a clamp biding is started (also "clamp biding start point B"). Further, reference numeral 300 in FIG. 19 represents a clamp binding range, starting from the point B, during which clamp binding is executed. In FIG. 19, the clamp binding range 300 of the distance L is from zero to about 0.5 mm (0 mm<L≤0.5 mm), and a force of about 1000 N is applied to the tooth forms 261. Reference numeral 400 represents a squeezing range (0.5 mm<L≤1.5 mm), and a force of about 100 N is applied to the tooth forms 261. At a point A, squeezing is started (also "squeezing start point A), and the squeezing start point A (1.5 mm in FIG. 19) can be determined according to the height of the projections of the tooth forms 261. An optimum size can be selected experimentally, and the squeezing start point A can be preset according to the thickness of the sheet bundle.

It can be known from FIG. 19 that the configuration shown in FIG. 18 can generate a necessary amount of force efficiently and more timely. More specifically, from the force output properties shown in FIG. 19, the configuration shown in FIG. 18 in which the link unit 270 is combined with the crank unit 271 can squeeze, clamp, and bind the sheet bundle more efficiently with a smaller driving force. Additionally, at the clamp biding start point B, the configuration shown in FIG. 18 can generate a greater force than the configuration shown in FIG. 17 using the crank mechanism 268 alone, and the force pressing the sheet bundle can increase more gradually. Thus, the configuration shown in FIG. 18 is advantageous in that damage to the sheet bundle is smaller in addition to the increased binding capability.

As described above, when the mechanism to move the second tooth form 261*b* is constructed of two or more of links or cams (a link unit and a crank mechanism in the configuration shown in FIG. 18), the amount of force for clamp binding can be generated timely, and the necessary driving force can be reduced. Thus, energy and resource for sheet binding can be saved.

Additionally, it can be also known from FIG. 19 that, in the configuration shown in FIG. 18, the pressing force can be applied earlier, that is, during the squeezing range 400 prior to clamp binding, and increased gradually. Since the pressing force gradually increases during transition from the squeezing range 400 to the clamp binding range 300 and further during the clamp binding range 300, the risk of damage to binding portions of the sheet bundle can be reduced. Thus, quality of sheet binding can improve.

It is to be noted that, although the link unit 270 is driven by the crank unit 271 in the configuration shown in FIG. 18, alternatively, the link unit 270 may be driven by a cam mechanism.

Figure 20:
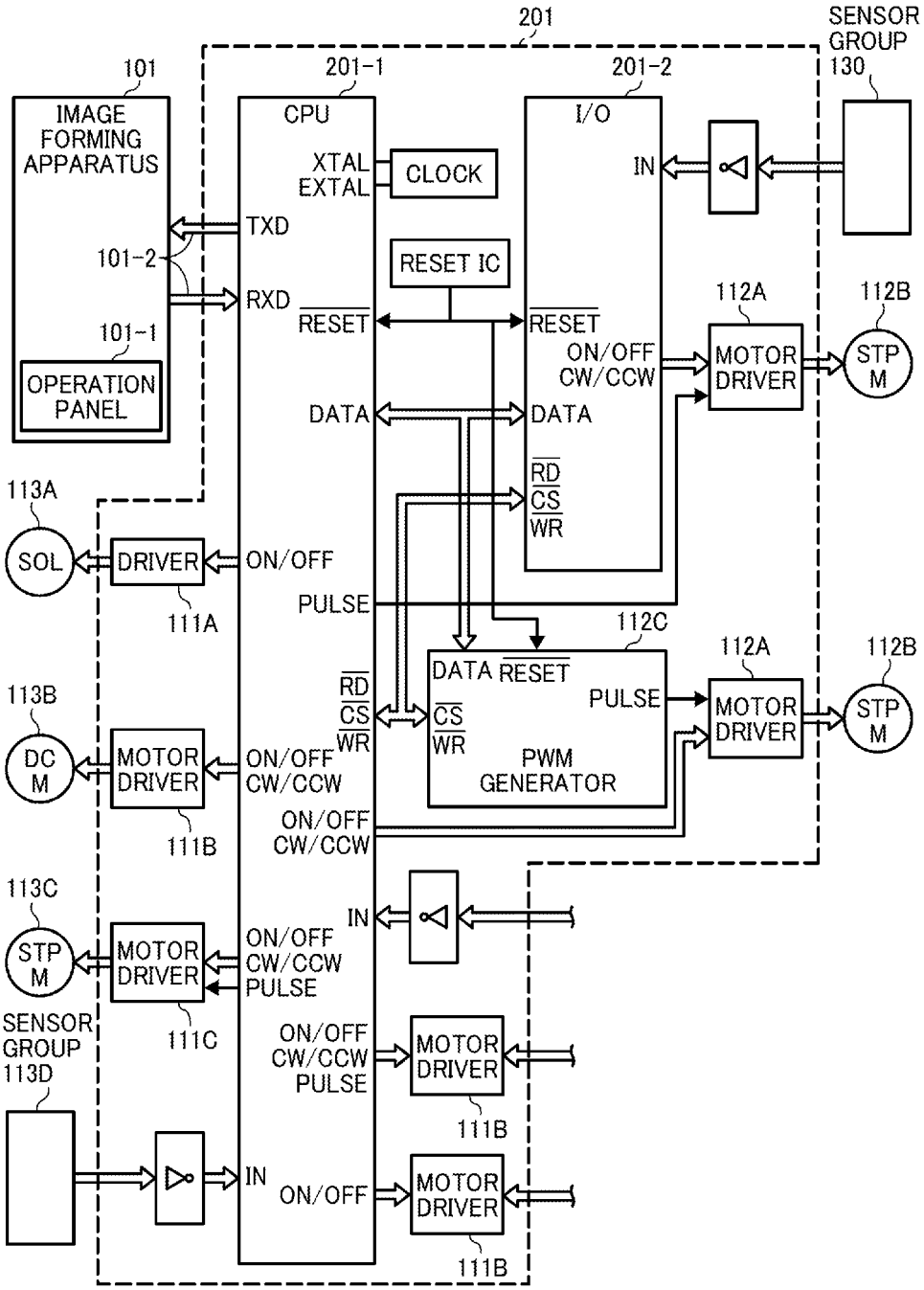
FIG. 20 is a block diagram that schematically illustrates a control configuration of the system including the sheet processing apparatus and the image forming apparatus shown in FIG. 1.

FIG. 20 is a block diagram that schematically illustrates a control configuration of the system including the image forming apparatus 101 and the sheet processing apparatus 201. The control circuit of the sheet processing apparatus 201 includes, for example, a micro computer including the CPU 201-1 and an input/output (I/O) interface 201-2. The CPU 201-1 performs various types of control according to signals input from either a CPU of the image forming apparatus 101 or a control panel 101-1, or signals received via the I/O interface 101-2 from respective switches as well as sensor groups 113D and 130 including various sensors and detectors. The control circuit further includes a pulse width module (PWM) generator 112C. Additionally, the CPU 201-1 controls a solenoid 113A, a direct current (DC) motor 113B, and stepping motors 112B and 113C via a driver 111A and motor drivers 111B, 111C, and 112A. The CPU 201-1 acquires data from the detectors in the apparatus via the interface 201-2. Further, according to what is controlled or sensors, the CPU 201-1 controls the motors 112B, 113B, and 113C and acquires data from the sensors via the I/O interface 101-2. The CPU 201-1 reads out program codes stored in a read only memory (ROM), and performs various types of control based on the programs defined by the program codes using a random access memory (RAM) as a work area and data buffer. The control circuit can further include a nonvolatile storage device for storing data used for control operations.

Moreover, the sheet processing apparatus 201 may be controlled according to instructions or data transmitted from the CPU of the image forming apparatus 101. Users can input instructions via the control panel 101-1 of the image forming apparatus 101. Then, the image forming apparatus 101 can transmit operation signals input via the control panel 101-1 to the sheet processing apparatus 201, and the state or functions of the sheet processing apparatus 201 can be reported to the user or operator on the control panel 101-1.

As described above, the present embodiment can attain the following effects.

1) The sheet binding device 210 according to the above-described embodiment includes first and second tooth forms 261*a* and 261*b*, having projections and recesses engaging each other, and the squeezing and clamping unit 269 to apply pressing force to the first and second tooth forms 261*a* and 261*b* in the thickness direction of the sheet bundle sandwiched between the first and second tooth forms 261*a* and 261*b*, thereby squeezing and binding the sheet bundle. The squeezing and clamping unit 269 is configured to apply a greater force to the first and second tooth forms 261*a* and 261*b* as the relative distance therebetween decreases. With this configuration, without increasing the strength of the driving force, the sheet bundle can be squeezed and bonded or bound together reliably. Consequently, energy required for sheet binding can be reduced.

2) The squeezing and clamping unit 269 is constructed with at least two displacement units such as the link unit 270 and the crank unit 271 serving as a link activation unit to activate the link unit 270. Even if the driving force of the crank unit 271 is constant, the pressing force generated between the first and second tooth forms 261*a* and 261*b* can be increased using the link unit 270 as the distance therebetween decreases. With this configuration, the sheet bundle can be squeezed and bonded or bound together reliably with a reduced driving force.

3) Since the squeezing and clamping unit 269 can set the strength of pressing force in accordance squeezing steps of the sheet bundle 272 by the first and second tooth forms 261*a* and 261*b*, driving force is not wasted. It is to be noted that squeezing operation (i.e., primary squeezing) of the squeezing and clamping unit 269 is executed from the point A in FIG. 19, at which the distance between the first and second tooth forms 261*a* and 261*b* reaches the thickness of the sheet bundle 272, to the point B at which clamp binding is started, and the clamp binding operation is executed from the point B to the point C at which sheet binding operation completes (hereinafter "binding completion point C").

4) According to the above-described embodiment, pressing force is applied to the tooth forms 261 in multiple steps. That is, in primary squeezing (i.e., the squeezing range 400) during which the distance L between the first and second tooth forms 261*a* and 261.*b* is reduced from the squeezing start point A, determined according to the thickness of the sheet bundle, to the clamp biding start point B, a first pressing force is applied to the tooth forms 261 for squeezing the sheet bundle. Then, a second pressing force greater than the first pressing force is applied to the tooth forms 261 in secondary squeezing (i.e., clamp binding range 300) narrower than the first range. With the two-step squeezing, clamp binding can be efficient.

5) A small driving force exerted by the drive motor 271*m* that drives the third connecting rod 271*a* can be converted into a greater force, namely, the second pressing force and transmitted to the link unit 270 including the first and second connecting rods 270*a* and 270*b*. With this configuration, the second pressing force at the binding completion point C can be increased to about 1000 N or greater, in the configuration shown in FIG. 19.

6) The squeezing and clamping unit 269 includes the link unit 270 and the crank unit 271 serving as the link activation. The link unit 270 includes the first and second connecting rods 270*a* and 270*b* and the first joint 269*a* capable of rotatably connecting together the first ends of the first and second connecting rods 270*a* and 270*b*. The crank unit 271 includes the third connecting rod 271*a* driven by the drive motor 271*m*. The second end of the first connecting rod 270*a* is connected to the movable second tooth form 261*b*, and the second end of the second connecting rod 270*b* is rotatably connected to the third joint 270*d* provided to the stationary member 270*f*. The first, second, and third connecting rods 270*a*, 270*b*, and 271*a* are arranged such that, when the third connecting rod 271*a* pushes the first joint 269*a* in the direction to stretch the first and second connecting rods 270*a* and 270*b*, the first joint 269*a* reaches the dead point immediately before the first and second connecting rods 270*a* and 270*b* are aligned with each other into single straight line. Accordingly, even if the driving force of the drive motor 271*m* is small, greater driving force can be attained.

7) The above-described embodiment concerns the sheet binding method in which the sheet bundle is inserted between the first and second tooth forms 261*a* and 261.*b* having projections and recesses shaped to engage each other, the squeezing and clamping unit 269 presses the first and second tooth forms 261*a* and 261*b* to squeeze the sheet bundle therebetween in the thickness direction of the sheet bundle, and thereby the sheet bundle is clamped and bound. Specifically, the method includes the step of squeezing the sheet bundle (i.e., the squeezing range 400) starting from the predetermined squeezing start point A to the clamp biding start point B at which the sheets contact closely with each other and the step of clamping the sheet bundle (i.e., the clamp binding range 300) starting from the clamp biding start point B to the binding completion point C. The step of squeezing corresponds to the first range of the distance L from the squeezing start point A to the clamp biding start point B, during which the first pressing force is applied to the tooth forms 261. The step of clamping corresponds to the second range of the distance L, narrower than the first range, from the point B to the point C, during which the second pressing force greater than the first pressing force is applied to the tooth forms 261. Thus, sheet binding is executed in two steps efficiently, saving energy.

It is to be noted that the present invention is not limited to the specific embodiments described above, and numerous additional modifications and variations are possible in light of the above teachings. It is therefore to be understood that, the disclosure of this patent specification may be practiced otherwise than as specifically described herein, and such variations, modifications, alternatives are within the technical scope of the appended claims.

What is claimed is:

1. A sheet processing apparatus comprising:

a pair of squeezing members including a projection and a recess to engage each other, to squeeze a sheet bundle inserted therebetween in a direction of thickness of the sheet bundle; and a pressure applying unit to apply pressing force to the pair of squeezing members to squeeze and bind the sheet bundle, the pressure applying unit includes:

a link unit; and a link activation unit to activate the link unit to generate the pressing force between the squeezing members, wherein the link unit of the pressure applying unit includes first and second connecting rods and a first joint to connect together a first end of the first connecting rod and a first end of the second connecting rod rotatably, and the link activation unit includes a crank unit that includes a third connecting rod connected to the first joint, the third connecting rod driven by the driving source, a second end of the first connecting rod is rotatably connected via a second joint to one of the squeezing members that is movable, a second end of the second connection rod is rotatably connected via a third joint to a stationary member, and the first, second, and third connecting rods are arranged such that, when the third connecting rod pushes the first joint in a direction to stretch the first and second connecting rods, the first joint reaches a dead point immediately before the first and second connecting rods are aligned with each other, wherein the pressing force generated between the squeezing members by the pressure applying unit increases in strength as a relative distance between the squeezing members decreases.

2. The sheet processing apparatus according to claim 1, wherein the link activation unit comprise either a crank unit or a cam unit driven by a driving source.

3. The sheet processing apparatus according to claim 1, wherein the sheet bundle is configured to be squeezed multiple times, and the pressure applying unit sets a strength of the pressing force according to the squeezed sheet bundle.

4. The sheet processing apparatus according to claim 3, wherein the squeezed sheet bundle is configured to be squeezed by:

primary squeezing from when the relative distance between the squeezing members reaches a set distance set according to the thickness of the sheet bundle to when the relative distance equals to the thickness of the sheet bundle; and secondary squeezing from when the relative distance between the squeezing members equals to the thickness of the sheet bundle to completion of sheet binding.

5. The sheet processing apparatus according to claim 4, wherein the pressure applying unit applies a first pressing force to the squeezing members during the primary squeezing, and the pressure applying unit applies a second pressing force stronger than the first pressing force to the squeezing members during the secondary squeezing.

6. The sheet processing apparatus according to claim 4, wherein the second pressing force is increased to 1000 N or greater before completion of the secondary squeezing.

7. An image forming system comprising:

an image forming apparatus to form images on recording media sheets; and the sheet processing apparatus according to claim 1, to bind the recording media sheets.

* * * * *